United States Patent [19]

Piguet et al.

[11] 4,444,512

[45] Apr. 24, 1984

[54] METHOD AND CIRCUIT FOR COMPARING THE TIMEKEEPING STATE AND CONTENTS OF A REGISTER IN AN ELECTRONIC REMINDER GIVING TIMEPIECE

[75] Inventors: Christian Piguet, Neuchâtel; Jean-Félix Perotto, Hauterive, both of Switzerland

[73] Assignee: Societe Suisse pour l'Industrie Horlogere Management Services S.A., Bienne, Switzerland

[21] Appl. No.: 313,516

[22] Filed: Oct. 21, 1981

[51] Int. Cl.[3] ..... G04B 23/02

[52] U.S. Cl. ..... 368/72; 368/73; 368/250; 368/251

[58] Field of Search ..... 368/10, 28, 29, 30, 368/41–44, 72, 73, 250, 251, 11; 364/705

[56] References Cited

U.S. PATENT DOCUMENTS

| | | | |
|---|---|---|---|
| 3,664,116 | 5/1972 | Emerson et al. . | |
| 3,664,117 | 5/1972 | McIntosh . | |
| 3,745,761 | 7/1973 | Tsuruishi . | |
| 3,759,029 | 9/1973 | Komaki . | |
| 4,093,992 | 6/1978 | Kawamura et al. | 364/705 |
| 4,270,194 | 5/1981 | Morokawa et al. | 368/73 |

FOREIGN PATENT DOCUMENTS

| | | |
|---|---|---|
| 2117756 | 1/1976 | Fed. Rep. of Germany . |
| 2643993 | 4/1977 | Fed. Rep. of Germany . |
| 2328236 | 5/1977 | France . |
| 610712 | 5/1979 | Switzerland . |

*Primary Examiner*—Ulysses Weldon

*Attorney, Agent, or Firm*—Griffin, Braingan & Butler

[57] ABSTRACT

For an electronic timepiece arranged and adapted to give reminders there is provided a method for comparing a timekeeping state (1) with the contents of a register (2), a circuit (3) for applying the method and a utilization of such circuit.

A programmable register (2) releases a signal whenever the contents of at least one counter (1) coincide with the contents of a portion of the register (2). In another portion of the register (2) is programmed the code of a state (−) which corresponding counters (1) will never attain under normal operations and the comparison (3) between the state of these counters (1) and that of said other portion of the register (2) is validated whatever may be the state. The comparison circuit (3) may be obtained from the arithmetic and logic units of a microprocessor as employed in a reminder giving timepiece.

5 Claims, 5 Drawing Figures

FIG.1
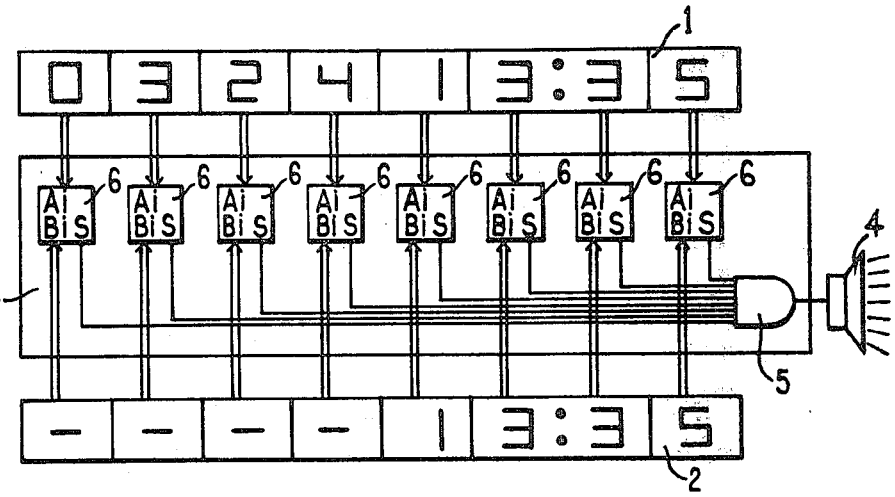
FIG.2
| Code BCD | Symbol |
|---|---|
| 0000 | 0 |
| 0001 | 1 |
| 0010 | 2 |
| 0011 | 3 |
| 0100 | 4 |
| 0101 | 5 |
| 0110 | 6 |
| 0111 | 7 |
| 1000 | 8 |
| 1001 | 9 |
| 1111 | –(hyphen) |
FIG.3
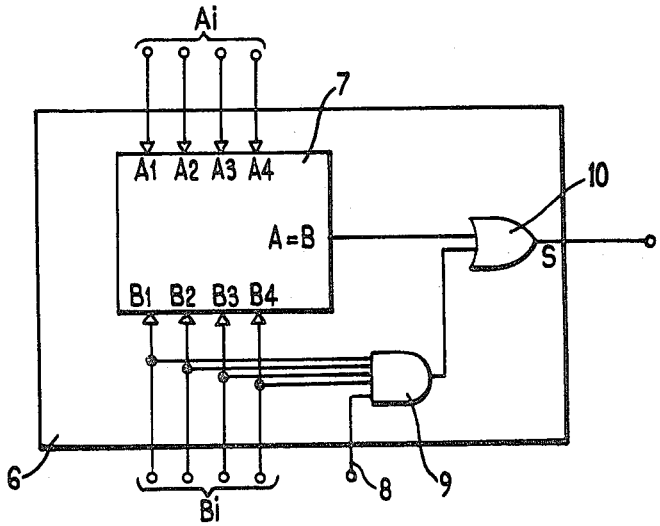

METHOD AND CIRCUIT FOR COMPARING THE TIMEKEEPING STATE AND CONTENTS OF A REGISTER IN AN ELECTRONIC REMINDER GIVING TIMEPIECE

BACKGROUND OF THE INVENTION

This invention concerns a method for comparing the timekeeping state of an electronic timepiece in order to release a warning or reminder signal having various periods which may be programmed into a register by the user, such release taking place when the timekeeping state of the timepiece arrives at least partially in coincidence with the contents of the register. The invention furthermore concerns a logic circuit for carrying out the method and use of this circuit in a timekeeping microprocessor.

A logic circuit for an alarm watch is described in the U.S. Pat. No. 3,759,029. In this case the register must necessarily at all times store the indication of hours, minutes and seconds and the periodicity of the reminder is thus necessarily always the same i.e. daily. Circuits of the same type giving the reminder at a fixed periodicity and capable of comparing respectively from tens of hours down to seconds and from hours down to tens of minutes may be found described in the U.S. Pat. No. 3,745,761 and Swiss Pat. No. 534 386.

A weekly periodicity, but weekly only, may also be obtained by means of the circuit described in German patent application No. 26 43 993 which compares from days to minutes. A comparator for hours and minutes in a watch having ten reminders is furthermore exposed in the German patent application No. 21 17 756.

None of these proposals enable the user to control completely the periodicity which is determined once and for all from the reminder which is programmed therein. It also appears to be of great utility to the user to choose according to his own needs the periodicity of the reminders which he expects from his timepiece.

SUMMARY OF THE INVENTION

It is this objective that the invention seeks to attain in proposing a method for comparison and a logic circuit for carrying out the method enabling the release of a warning signal whenever the contents of at least one timekeeping counter of the timepiece comes into coincidence with the contents of the corresponding part of the register in which has been programmed the reminder indication, the other portion of such register containing instead of time information a state which the corresponding timekeeping counters will never attain in normal operation, for instance the code of a non-numerical symbol such that the comparison between the state of the corresponding timekeeping counters whatever this may be and the contents of the other portion of the register are always validated. Such an arrangement permits the user to programme any desired periodicity for his reminder, for example, daily, weekly, monthly or yearly.

BRIEF DESCRIPTION OF THE DRAWINGS

FIG. 1 is a schematic representation of a comparison circuit in accordance with the invention.

FIG. 2 illustrates the code which may be used for the programming of the register of the circuit of FIG. 1.

FIG. 3 represents a stage of the basic comparator of the same circuit.

DETAILED DESCRIPTION OF THE DESCRIPTION

Figure 4:
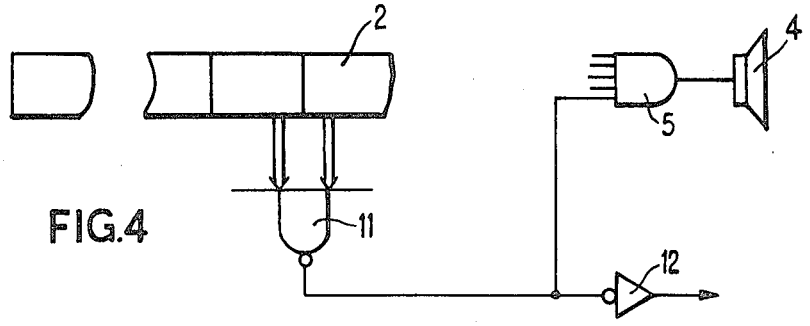
FIG. 4 shows an arrangement permitting within the framework of the invention to inhibit an audible type of reminder in favour of a visual reminder whenever minutes are not specified.

The timekeeping state of the timepiece appears in the timekeeping counters 1 containing information relating respectively to the minutes ("35"), the hours ("13"), the days of the month ("24") and the months ("03"). A programmable register 2 is formed by stages each corresponding to an element of information present in counters 1. Counters 1 and register 2 are connected to the display permitting thus the visualisation of their respective contents. In the portion of register 2 corresponding to the hours and to the minutes, there have been as shown in the example respectively programmed 13 hours ("13") and 35 minutes ("35"). In each stage of the other portion of register 2 has been programmed a symbol corresponding in the present case to a dash ("-"). Other types of symbol could also be programmed, the essential being that the symbol represents a state which the corresponding timekeeping counters 1 will never attain during normal function of the timepiece. A comparator circuit 3 is formed from comparator elements 6 for each of the information items (eight in the present case) and with a logic AND gate 5. Each comparator element 6 receives at its inputs information Ai and Bi corresponding respectively to each basic information item contained in the timekeeping counters 1 and in register 2. Whenever there is identity between information A1 and corresponding information Bi, or in the case where the information Bi represents a symbol "-", comparator 6 will provide a signal S at the "1" logic level which will be applied to AND gate 5. In the example as shown, this is permanently the case for all stages other than those relative to the hours and the minutes and, when the counters 1 (hours and minutes) arrive at thirteen hours and thirty-five minutes, the four comparators 6 concerned will each furnish a signal S at the logic level "1" thereby enabling AND gate 5 to transmit a signal so as to actuate warning element 4 which may for instance be a loud-speaker. One minute later, at thirteen hours thirty-six minutes, the enabling signal will stop and AND gate 5 will no longer transmit an actuating signal until the timekeeping state of the timepiece as shown in counters 1 arrives at "03 25 13:35" and at this moment the warning element 4 will once again be actuated. One thus obtains a daily reminder, at the time thirteen hours thirty-five.

Should the user programme into register 2 "- - 24 13:35" the month no longer being specified and being represented only by the symbols "- -", a reminder will take place monthly on the 24th day at thirteen hours thirty-five. In the same manner if all positions of register 2 are filled by a numerical symbol corresponding to a possible state of the counter 1, thus without any "-" symbol, or other impossible state for counters 1, there will be an annual periodicity for the reminder, thus the programming "05 21 13:35" will bring about a warning every 21st of May at thirteen hours thirty-five.

It is possible in the same manner to programme a weekly periodicity by providing a read-out for the comparison of the date counter and the day counter. Thus programming "- - SA 10:30" would give a reminder every Saturday at ten thirty. Although this example is not specifically illustrated, it will be evident to the man skilled in the art from what has just been exposed.

FIG. 3 shows a particular arrangement for the comparator element 6 for the timekeeping counters 1 of which the code includes four bits such as the BCD code shown in FIG. 2, and where an impossible state of the counters 1 is shown by the non-numerical symbol dash "-" and is obtained for example by the code "1111". Bits $A_1$, $A_2$, $A_3$, $A_4$ represent information Ai obtained from one of the counters 1 and the bits $B_1$, $B_2$, $B_3$, $B_4$ the information Bi obtained from the corresponding portion of the register 2 where has been programmed the reminder time. The circuit 7 may be a four bit comparator such as for example the circuit 7485 well known in the TTL technology (Transistor-Transistor-Logic). If Ai=Bi i being equal to 1, 2, 3 or 4, the output of circuit 7 will be at the logic level "1" and the signal will pass through the OR gate 10 whereby the output S of the comparator element 6 will also have a logic level "1" and this whatever may be the logic level at the output of the AND gate 9. AND gate 9 receives bits $B_1$, $B_2$, $B_3$, $B_4$ and a further input 8. If the input 8 is at the "0" level, the output of AND gate 9 will always be at the same "0" level, and the comparator element 6 therefore will operate as a simple four bit comparator, the OR gate 10 being unable to provide a signal "1" to AND gate 5, except when Ai=Bi. If on the other hand the input 8 is at the level "1", the comparator element 6 will be a four bit comparator where the comparison will be validated whenever $B_1=B_2=B_3=B_4=1$ that is to say when the symbol "-" is placed in the corresponding stage of register 2, and whatever may be the values $A_1$, $A_2$, $A_3$, $A_4$ furnished by the corresponding counter 1. Effectively the output of AND gate 9 will always be at the logic level "1" and consequently that of OR gate 10 as well.

FIG. 4 shows a special case where in register 2 the minutes have not been specified. The stages therein store for instance a code "1111" corresponding to the dash symbol "-".

In this latter arrangement it is desirable that the warning or reminder not be audible since of too long duration and therefore should be substituted by a visual warning. Hence NAND gate 11 is connected to an output of register 2 thereby to provide a logic level "0" which will inhibit the audible warning device 4 by blocking AND gate 5, but at the same time will actuate a visual indicator (not shown) by means of an inverter 12. This arrangement may be used for a daily reminder by programming only the information concerning the hour, the remainder of register 2 comprising throughout the code of the dash symbol "-" or another impossible state of the counters 1. In the same manner, in specifying only the date, that is to say the day and the month, it will be possible to programme anniversaries, for instance "07 21 - -:- -" the 21st July of each year.

Figure 5:
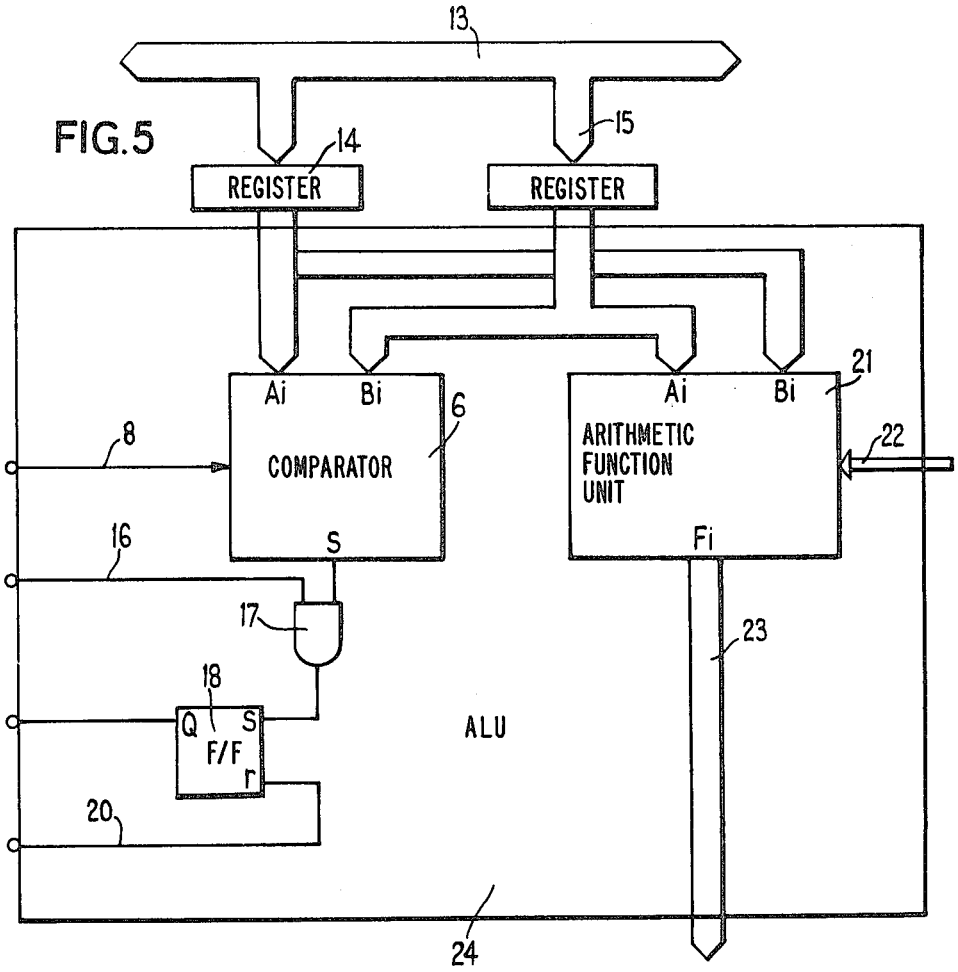
FIG. 5 shows a possible arrangement of the basic comparator of FIG. 3 within the arithmetic and logic units of a timekeeping microprocessor.

A variant by which the comparator element 6 may be obtained is shown in FIG. 5. It is applied as a special function in an arithmetic and logic unit (ALU) 24 in a timekeeping microprocessor. A bus 13 enables the loading of two registers 14 and 15 with the contents of two counters or timekeeping registers to be compared. If the two contents are identical or if the code contained in the remainder register is that of the "-" symbol, the output signal S of comparator 6 is at the logic level "1". This signal may be applied as an input to an AND gate 17 and a signal 16 is applied as a second input to this same gate enabling through an instruction of the microprocessor the application of this comparison operation. In this case, the output of AND gate 17 at level "1" sets the indicator or flag 18 whenever the comparison is valid. The output signal Q of flag 18 is sensed by the microprocessor in order to determine if the comparison has been effected, and a signal 20 enables re-setting flag 18 to zero. In addition a signal 8 enables by means of an instruction from the microprocessor to choose, at will as in the preceeding case, a simple comparison when signal 8 is at level "0" or a validated comparison for which case the signal 8 is at level "1".

The arithmetic and logic unit 24 may comprise moreover a circuit 21 such as the well known type TTL-74 181 and which receives as an input the outputs of the two registers 14 and 15 and for which the output is on bus 23, control input variables 22 enabling one to select the operation to be effected.

In order to programme the programmable register 2 of FIG. 1 or its eqivalent of FIG. 5, one may employ a system such as shown in the Swiss Pat. No. 610 712 in which one may use two switches one of which operates as a selector and the other as a corrector. The selector is operated in order to provide a signal to an electronic counter for which the contents, determined by the number of times the selector has been operated, is sent to a correction circuit. The corrector switch may in its turn be operated in order to provide signals to the selected stage of register 2 in order to change its contents. For each impulse the contents may be increased by a unit and it is well understood that the counting possibilities may permit the introduction of the dash symbol "-" or other impossible state of counters 1. It is furthermore possible that the corrector may transmit a series of pulses in place of a single pulse at the time of its actuation.

What we claim is:

1. An actuating circuit for warning means in an electronic timepiece operable whenever at least certain counters within a divider chain arrive at a state corresponding to a predetermined storage state, comprising:

a programmable register having a plurality of stages each corresponding to a counter of said divider chain, each of said stages being individually capable of being placed either in said storage state or in a validation state, said validation state comprising a state which the counter may never attain during normal operation;

a plurality of comparison circuits respectively associated with each of said stages whereby each said comparison circuit may generate an enabling signal whenever there is coincidence between the state of its associated stage and that of the corresponding counter or whenever the corresponding stage is in said validation state, each comparison circuit comprising a conventional N-bit comparator arranged to receive N number of bits respectively from a counter of the divider chain and the corresponding register stage, an associated OR gate the output of which constitutes an enabling input to a gate circuit means which actuates the warning means, said OR gate receiving an input whenever there is identity between the elements of the two sets of N bits, an associated AND gate arranged to receive the N bits from the register stage as well as an enabling signal and to provide an output whenever the N bits from said register stage represent the code of the validation stage, the output from said AND gate providing a further input to said OR gate; and, said gate circuit means being arranged to actuate said warning means whenever all comparators simultaneously generate said enabling signal.

2. An actuating circuit as set forth in claim 1 wherein said circuit is obtained by the arithmetic and logic unit of a timepiece microprocessor.

3. An actuating circuit for warning means in an electronic timepiece operable whenever at least certain counters within a divider chain arrive at a state corresponding to a predetermined storage state, comprising:

a programamble register having a plurality of stages each corresponding to a counter of said divider chain, each of said stages being individually capable of being placed either in said storage stage or in a validation state;

a plurality of comparison circuits respectively associated with each of said stages whereby each said comparison circuit may generate an enabling signal whenever there is coincidence between the state of its associated stage and that of the corresponding counter or whenever the corresponding stage is in said validation state;

a gate circuit arranged to actuate said warning means whenever all comparators simultaneously generate said enabling signal; and, a NAND gate associated with the register stage corresponding at least either to the minutes or hours or days or months counter, the output of said NAND gate being applied as an input to the gate circuit which actuates the warning means and as well via an inverter to control a second warning means different from the first warning means whereby when comparison is attained by means of the validation state in register stages associated with said NAND gate the first-mentioned warning means is inhibited and the second warning means is enabled.

4. An actuating circuit as set forth in claim 3 wherein the first-mentioned warning means provides an audio signal and the second warning means provides a visible signal.

5. An actuating circuit as set forth in claim 3 wherein said circuit is obtained by the arithmetic and logic unit of a timepiece microprocessor.

* * * * *